US006578332B2

(12) United States Patent
Bushberger

(10) Patent No.: US 6,578,332 B2
(45) Date of Patent: Jun. 17, 2003

(54) FOUNDATION SEAL

(76) Inventor: Todd E. Bushberger, 3154 S. Toldt Pkwy., West Allis, WI (US) 53227

( * ) Notice: Subject to any disclaimer, the term of this patent is extended or adjusted under 35 U.S.C. 154(b) by 0 days.

(21) Appl. No.: 10/016,320

(22) Filed: Dec. 10, 2001

(65) Prior Publication Data

US 2002/0062610 A1 May 30, 2002

Related U.S. Application Data

(60) Provisional application No. 60/255,558, filed on Dec. 14, 2000.

(51) Int. Cl.[7] ..... E02D 27/00

(52) U.S. Cl. ..... 52/293.3; 52/292; 52/274; 52/420

(58) Field of Search ..... 52/292, 274, 293.1, 52/293.3, 420, 169.11, 408, DIG. 15, DIG. 16

(56) References Cited

U.S. PATENT DOCUMENTS

| | | | | | |
|---|---|---|---|---|---|
| 1,761,410 | A | | 6/1930 | Rose | |
| 2,859,486 | A | | 11/1958 | Rovich | |
| 3,280,525 | A | * | 10/1966 | Crowley | 52/223.3 |
| 3,385,016 | A | * | 5/1968 | Crom | 52/293.3 |
| 3,636,673 | A | * | 1/1972 | Monroe | 52/293.3 |
| 4,123,889 | A | * | 11/1978 | Deloupy | 52/742.12 |
| 4,176,504 | A | * | 12/1979 | Huggins | 52/61 |
| 4,409,766 | A | | 10/1983 | Blackmore | |
| 4,996,092 | A | * | 2/1991 | Francis et al. | 428/157 |
| 5,091,235 | A | * | 2/1992 | Vergnano | 428/192 |
| 5,218,793 | A | | 6/1993 | Ball | |
| 5,268,228 | A | * | 12/1993 | Orr | 428/343 |
| 5,300,171 | A | * | 4/1994 | Braun et al. | 156/249 |
| 5,403,414 | A | * | 4/1995 | Corston | 156/71 |
| 5,553,431 | A | * | 9/1996 | Pelosi et al. | 52/287.1 |
| 5,605,028 | A | | 2/1997 | Cawte | |
| 5,678,362 | A | | 10/1997 | Hulls et al. | |
| 5,937,600 | A | | 8/1999 | Larson | |
| 6,076,320 | A | | 6/2000 | Butler | |
| 6,298,619 | B1 | * | 10/2001 | Davie | 52/293.3 |
| 6,331,337 | B1 | * | 12/2001 | Osborn et al. | 428/61 |
| 6,405,508 | B1 | * | 6/2002 | Janesky | 52/741.4 |
| 6,413,626 | B1 | * | 7/2002 | Wollner | 428/317.3 |
| 6,494,977 | B1 | * | 12/2002 | Waldenberger et al. | 156/78 |

* cited by examiner

*Primary Examiner*—Jeanette Chapman
(74) *Attorney, Agent, or Firm*—Andrus, Sceales, Starke & Sawall, LLP

(57) ABSTRACT

A building foundation sealing member is adapted to fit between a building frame and a building foundation wherein the building foundation includes an upper facing surface and the building frame has a surface disposed above and in opposed relation to the upper facing surface. The sealing member includes an elongated strip having oppositely facing upper and lower surfaces and oppositely facing edges extending between the upper and lower surfaces. A membrane is attached to one of the oppositely facing edges and includes oppositely projecting seal surfaces extending beyond the upper and lower strip surfaces. The membrane has an adhesive coating on the surface thereof facing forward the strip. One adhesive surface is adapted to be attached to the foundation and the other is adapted to be attached to the building frame.

10 Claims, 1 Drawing Sheet

FOUNDATION SEAL

CROSS-REFERENCE TO RELATED APPLICATIONS

This application is based on Provisional Application U.S. Serial No. 60/255,558 filed Dec. 14, 2000.

FIELD OF THE INVENTION

The present invention relates generally to building materials, and more particularly to seals between a foundation and a house frame.

BACKGROUND OF THE INVENTION

Modern homebuilders are continually trying to make new homes as energy efficient as possible. Improving a home's airtight seal can greatly reduce the heating and air-conditioning costs for a home. When a home is built, there are often small gaps around windows and doors through which air and moisture can pass. Applying building tape to these gaps in the building is a common practice that greatly increases a home's energy efficiency. The building tape creates an air and moisture barrier at the junction between a building's walls and doors or windows to make the home more airtight.

The foundation of a home is usually constructed of either poured concrete or concrete blocks. Many builders prefer to use a poured concrete foundation because of its superior strength qualities, as compared to a concrete block foundation. However, poured concrete shrinks as it dries and often settles unevenly. Because of these problems, the top edge of a foundation is usually an uneven, irregular surface.

The wooden floor deck of a home is supported on the top edge of the foundation. A sill plate is the lowest portion of the floor deck that usually lies on the foundation. The wooden sill plate will often warp or rot as it is exposed to moisture. Large gaps can be created between the foundation and the sill plate as the concrete foundation dries and settles and the wooden sill plate warps.

It is known to place a sill plate sealer between the foundation and the floor deck. A standard sill plate sealer is a foam piece that is approximately 0.25 inches thick, but the gap created between the foundation and the sill plate is often more than 0.25 inches. Air and moisture can still pass through this gap to lower the home's energy efficiency and rot the wooden sill plate. Therefore, it is desirable to have a product that creates an improved seal between a foundation and a sill plate that can close larger gaps.

SUMMARY OF THE INVENTION

The present invention is a foundation seal that creates an air and moisture barrier and preferably seals the joint between a home foundation and the wooden floor deck of a home. The foundation seal is preferably T-shaped and includes a foam strip and a flexible membrane. The membrane is preferably attached to the edge of the foam strip to create a T-shape when viewed from the end of the foundation seal.

The foam strip is preferably made from a lightweight polyethylene foam, or similar type foam. The foam strip is preferably a flat, elongated member with an upper surface, a lower surface, an interior edge, and an exterior edge. The lower structure of the strip is provided with an adhesive coating which is covered by a release strip to prevent the strip lower surface from prematurely adhering to any element before the strip is installed. The membrane is a flexible strip with an inner face and an outer face. The inner face preferably has a peel and stick adhesive coating, and is bonded to the exterior edge of the foam strip. The outer face has a non-adhesive backing so that only the inner face is tacky. A release liner is placed on the exposed tacky portion of the adhesive inner face to prevent the membrane from adhering to anything before application of the seal.

The foundation seal is installed at the joint of the foundation/slab and the floor deck, mud sill, sill plate or wall plate. The release liner is removed from the adhesive lower surface of the strip so that the foam strip can be attached to the top edge of the concrete. The foam strip is placed between the foundation and the floor deck, mud sill, sill plate or wall plate so that the tacky inner face of the membrane is aligned with the outer surface of the foundation and the floor deck, mud sill, sill plate or wall plate. The release liner is removed from the tacky portion of the membrane, and the adhesive on the inner face is applied to both the foundation and floor deck, mud sill, sill plate or wall plate. The seal preferably adheres immediately. The peel and stick adhesive membrane will preferably not deteriorate during the life of the structure, and adheres to concrete, foam, metal, masonry block, vinyl, wood and other similar materials.

After the foundation seal is applied, the foam strip and membrane combine to create a seal that eliminates virtually any air or moisture infiltration between the foundation and floor deck, mud sill, sill plate or wall plate. The present invention closes gaps between the foundation/slab and wood frame construction that normally develop as the foundation shrinks or settles, and the floor deck warps. Since the flexible membrane adheres to the foundation and floor deck, mud sill, sill plate or wall plate, it can maintain a seal even after shrinking, settling, or warping causes the foundation and floor deck to separate. The present invention can also seal gaps that are larger than the thickness of the foam strip. This seal preferably increases the energy efficiency of a home and reduces heating and cooling costs.

The invention further contemplates a foundation seal comprised of a foam strip having one protectively covered adhesive surface for adherence to one surface between adjacent building elements or to one building element itself.

Figure 1:
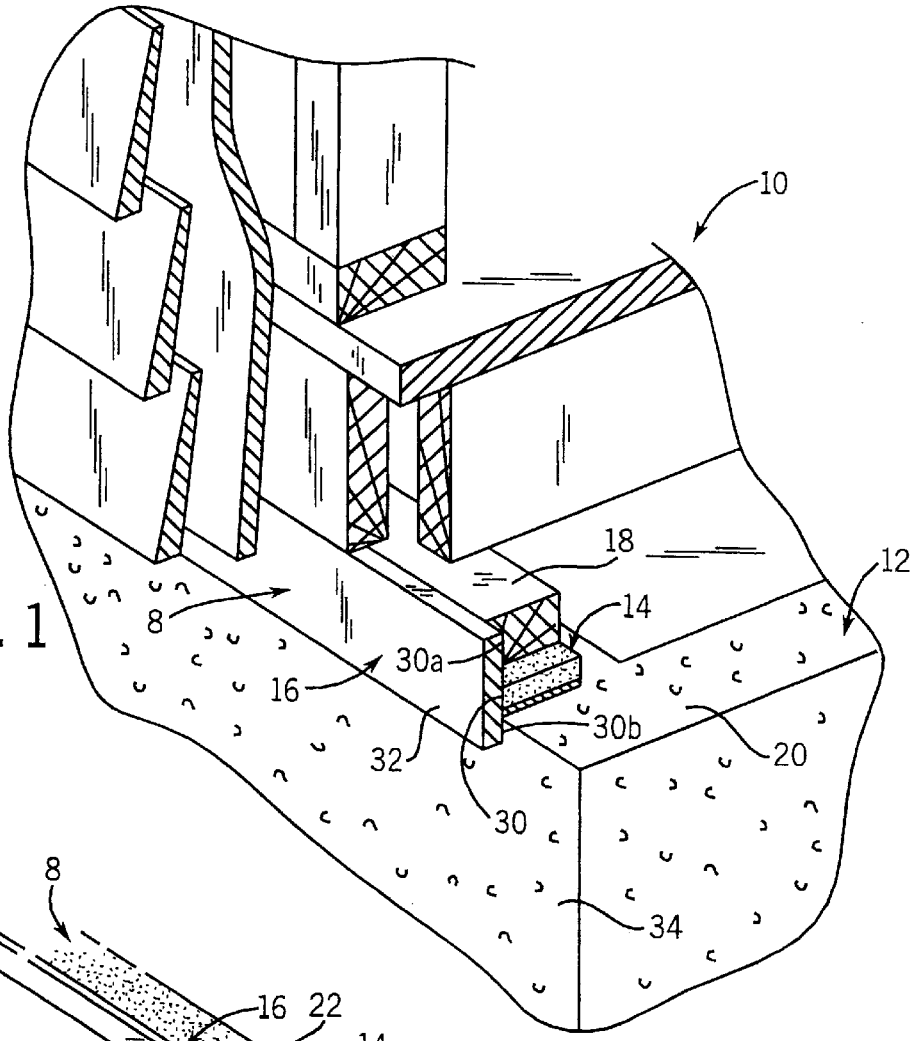
FIG. 1 is a perspective view of an installed foundation seal between a foundation and a floor deck.

Before the embodiments of the invention are explained in detail, it is to be understood that the invention is not limited in its application to the details of construction and the arrangement of components set forth in the following description or illustrate in the drawings. The invention is capable of other embodiments and of being practiced or of being carried out in various ways. Also, it is to be understood that the phraseology and terminology used herein is for the purpose of description and should not be regarded as limiting.

DETAILED DESCRIPTION OF THE INVENTION

FIG. 1 illustrates the foundation seal 8 of the present invention installed between a foundation 12 and a floor deck, mud sill, sill plate or wall plate 10. A foundation 12 is commonly made from either poured concrete or concrete blocks. A poured concrete foundation is often stronger than a concrete block foundation, but poured concrete usually shrinks as it cures to make the top edge 20 an uneven, irregular surface. Both poured concrete and concrete blocks can also settle unevenly to vary the surface of the top edge 20.

The wooden floor deck 10 of a home is supported by the top edge 20 of the foundation 12. The sill plate 18 is the lowest portion of the floor deck, mud sill, sill plate or wall plate 10 that rests on the top edge 20. After the home is built, the concrete foundation 12 may continue to shrink or settle, and the wooden floor deck 10 may warp. This movement and distortion can create gaps between the sill plate 18 and the top edge 20 through which air and moisture can pass.

In the present invention, the foundation seal 8 preferably creates a seal between the foundation 12 and the floor deck, mud sill, sill plate or wall plate 10, and forms a barrier for air and moisture. The foundation seal 8 is placed on top of the foundation 12 during the building process, and the floor deck, mud sill, sill plate or wall plate 10 is then installed on top of the foundation seal 8.

Figure 2:
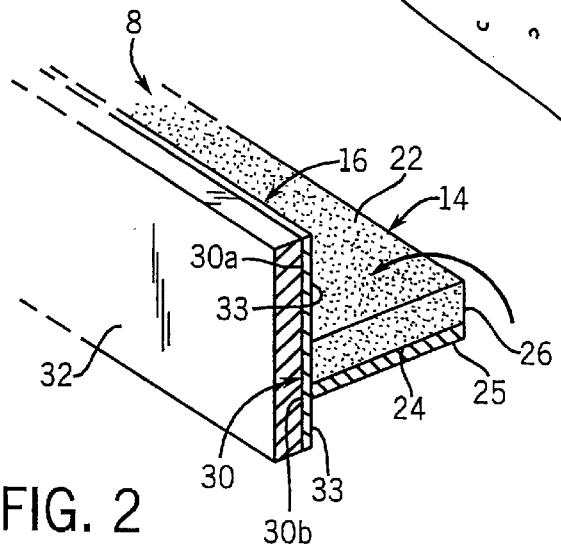
FIG. 2 is a perspective view of the foundation seal.

As illustrated in FIG. 2, the foundation seal 8 is preferably T-shaped and includes a foam strip 14 and a flexible membrane 16. The foam strip 14 is preferably a flat elongated member made of lightweight polyethylene foam, or similar material, and has an upper surface 22, a lower self-adhesive surface 24, an interior edge 26, and an exterior edge 28. The lower surface 24 of foam strip 14 is provided with an adhesive which is covered by a release liner 25 to prevent lower surface 24 from prematurely adhering to any element before the foam strip 14 is installed.

The flexible membrane 16 is preferably a flat elongated strip made from peel and stick adhesive and has an inner face 30 and an outer face 32. The inner face 30 has an upper seal surface 30*a* and a lower seal surface 30*b*. The upper seal surface 30*a* projects beyond the upper surface 22, and the lower seal surface projects below the lower surface 24. The peel and stick adhesive on the inner face 30 between seal surfaces 30*a*, 30*b* is bonded to the exterior edge 28 of the foam strip 14. The outer face 32 has a non-adhesive backing so that only the inner face 30 is tacky. A release liner 33 is placed over the remaining tacky portions 30*a*, 30*b* of the inner face 30 to prevent the membrane 16 from prematurely adhering to anything before the foundation seal 8 is installed.

As shown in FIG. 1, the foundation seal 8 is installed between the foundation 12 and the floor deck, mud sill, sill plate or wall plate 10. The release liner 25 is removed from the adhesively coated lower surface 24 so that the foam strip 14 can be attached to the top edge 20 of the concrete. The foam strip 14 is preferably placed along the top edge 20 of the foundation 12 so that membrane 16 is aligned with the outer wall 34 of the foundation 12. The floor deck, mud sill, sill plate or wall plate 10 is preferably installed on top of the foundation seal 8. The release liner 33 is preferably removed from the seal surfaces 30*a*, 30*b* of inner face 30 to expose the tacky adhesive, and the membrane 16 is bonded to the foundation 12 and floor deck, mud sill, sill plate or wall plate 10.

The foundation seal 8 preferably prevents virtually any air or moisture from passing through the joint between the foundation 12 and floor deck, mud sill, sill plate or wall plate 10, so it can maintain a seal as the concrete and wood shift, settle, shrink, or warp. The membrane 16 also seals gaps between the foundation/slab, and the floor deck, mud sill, sill plate or wall plate that are larger than the thickness of the foam strip 14. The foundation seal 8 improves the airtight characteristics of a home to improve its energy-efficiency and reduce heating and cooling costs. Also, the foundation seal 8 substantially prevents moisture, insects or rodents from infiltrating the gap between the foundation 12 and floor deck, mud sill, sill plate or wall plate 10. The adhesively coated surfaces 24, 30 provide perfect placement of the foam strip 14.

Figure 3:
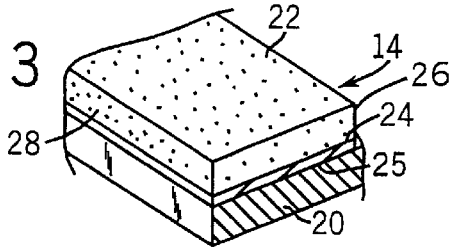
FIG. 3 is a fragmentary, perspective view of an adhesive backed foam strip used as a self-adhesive plate liner or sill sealer without the front flap.

In some instances, it may be desirable to use the foam strip 14 as a wall plate liner or sill sealer without the need for the flexible membrane 16 as shown in FIG. 3. In this case, the release liner 25, covering the adhesive on lower surface 24 is removed and the foam strip 14 may be installed. For example, in FIG. 1, the adhesive on lower surface 24 is placed directly on top of the top edge 20 of the concrete foundation 12 between the sill plate 18 and the edge 20. Alternatively, the adhesive on lower surface 24 can be placed directly on top of the top edge of the concrete foundation/slab, or masonry block 12 itself as shown in FIG. 3.

While the invention has been described with reference to a preferred embodiment, those skilled in the art will appreciate that certain substitutions, alterations and omissions may be made without departing from the spirit thereof. Accordingly, the foregoing description is meant to be exemplary only, and should not be deemed limitative on the scope of the invention set forth in the claims.

I claim:

1. A home building foundation sealing member adapted to fit between a home building frame subject to warping and a home building foundation subject to settling, the home building foundation including an upper facing surface and the home building frame having a surface disposed above and in opposed relation to the foundation upper facing surface, the sealing member comprising:

an elongated strip having oppositely facing upper and lower surfaces and oppositely facing edges extending between the upper and lower surfaces, a flexible membrane attached to one of the oppositely facing edges and including oppositely projecting seal surfaces extending beyond the upper and lower strip surfaces, the membrane having an adhesive coating on the seal surfaces thereof facing forward the strip, and the membrane seal surfaces having the adhesive coating thereon adapted to be attached one to the foundation and one to the building frame, the sealing member being installed on site during a building process and closing gaps between the frame and the foundation which eventually develop as the foundation settles and the frame warps.

2. The sealing member of claim 1, wherein the strip and the membrane form a substantially integral T-shaped construction.

3. The sealing member of claim 1, wherein the strip is constructed of a flat, elongated material formed from foam.

4. The sealing member of claim 1, wherein the strip is constructed of gasket-like material.

5. The sealing member of claim 1, wherein the membrane is constructed of a flat, elongated material formed with peel and stick adhesive.

6. The sealing member of claim 1, wherein the membrane has a non-adhesive, outer face opposite the adhesive, inner face.

7. The sealing member of claim 1, wherein the lower surface of the strip is provided with an adhesive coating which is covered by a release strip to prevent the lower surface from prematurely adhering to any element before the strip is installed.

8. A method of forming a home foundation seal between a home building foundation and a floor deck, mud sill, sill plate or wall plate to prevent the passage of air and moisture therebetween, the method comprising the steps of:

providing a strip having oppositely facing upper and lower surfaces and oppositely facing edges extending between the upper and lower surfaces, a membrane being attached to one of the oppositely facing surfaces and including oppositely projecting seal surfaces extending beyond the upper and lower strip surfaces, said membrane having an adhesive coating on the seal surfaces facing forward the strip;

placing the strip along a top edge of the foundation such that the membrane is aligned with an outer wall of the foundation; and attaching one of the adhesively coated membrane seal surfaces to a sill plate on the floor deck and attaching another of the adhesively coated membrane seal surfaces to the outer wall of the foundation during a building process.

9. The method of claim 8, including the step of providing the lower surface of the strip with an adhesive.

10. The method of claim 9, wherein the step of placing the strip along the top edge of the foundation includes placing the adhesively coated lower surface of the strip against the top edge of the foundation.

* * * * *

Disclaimer 6,578,332—Todd E. Bushberger, 3154 S. Toldt Pkwy., West Allis, WI (US) 53227. FOUNDATION SEAL. Patent Dated June 17, 2003. Disclaimer filed July 31, 2006 by Attorney of Record.

Hereby enters this disclaimer to claims 7, 9 and 10, of said patent.

*(Official Gazette October 3, 2006)*